US010532447B2

(12) United States Patent
Hamby

(10) Patent No.: US 10,532,447 B2
(45) Date of Patent: Jan. 14, 2020

(54) COMBINATION CASTLENUT AND BARRELNUT SOCKET ADAPTER FOR USE WITH TORQUE CREATING DEVICES

(71) Applicant: David M. Hamby, Montgomery, TX (US)

(72) Inventor: David M. Hamby, Montgomery, TX (US)

( * ) Notice: Subject to any disclaimer, the term of this patent is extended or adjusted under 35 U.S.C. 154(b) by 200 days.

(21) Appl. No.: 15/663,744

(22) Filed: Jul. 29, 2017

(65) Prior Publication Data

US 2019/0030690 A1 Jan. 31, 2019

(51) Int. Cl.

| | |
|---|---|
| ***B25B 13/48*** | (2006.01) |
| ***F41A 21/48*** | (2006.01) |
| ***B25B 23/10*** | (2006.01) |
| ***F41A 35/00*** | (2006.01) |
| *F41A 11/00* | (2006.01) |

(52) U.S. Cl.

CPC ..... *B25B 13/48* (2013.01); *B25B 23/108* (2013.01); *F41A 21/48* (2013.01); *F41A 35/00* (2013.01); *F41A 11/00* (2013.01)

(58) Field of Classification Search

CPC ..... B25B 13/48; B25B 13/50; B25B 13/5008; B25B 13/00; F41A 21/48; F41A 35/00; F41A 11/00

See application file for complete search history.

(56) References Cited

U.S. PATENT DOCUMENTS

| | | | | |
|---|---|---|---|---|
| 4,837,962 | A * | 6/1989 | Longerot | F41A 21/40 42/90 |
| 5,586,790 | A * | 12/1996 | Bynum | F16L 19/005 285/315 |
| 6,428,354 | B1 | 8/2002 | Meyer et al. | |
| 6,711,975 | B1 | 3/2004 | Vollmer | |
| 6,745,649 | B1 * | 6/2004 | Liao | B25B 13/06 81/121.1 |
| 6,959,509 | B2 | 11/2005 | Vais | |
| D548,552 | S * | 8/2007 | Elkaim | F41A 35/00 D22/199 |
| D564,316 | S | 3/2008 | Elkaim | |
| D598,723 | S * | 8/2009 | Cheng | D8/17 |
| D601,393 | S * | 10/2009 | Cui | D8/17 |
| 7,988,488 | B2 | 8/2011 | Orlando | |
| 8,069,604 | B2 | 12/2011 | Larue | |
| 8,091,266 | B2 | 1/2012 | Huang | |
| D666,883 | S * | 9/2012 | Howard | F41A 35/00 D8/19 |
| 8,701,526 | B2 * | 4/2014 | Scott | B25B 13/065 29/426.5 |
| 8,800,193 | B1 | 8/2014 | Frear, Jr. | |

(Continued)

OTHER PUBLICATIONS

Internet web page: http://www.sahuaritaguns.com/sendfriend/product/send/id/131/cat_id/98/ by sahuaritaguns.com, "AR15 Torque Wrench Barrel Nut Adapter for Narrow Profile Free Floating Quad Rail GT10H, GT12H.".

(Continued)

*Primary Examiner* — Christopher R Harmon

(74) *Attorney, Agent, or Firm* — Hamby Law Firm; Bruce W. Hamby

(57) ABSTRACT

This disclosure describes embodiments of a combination castlenut and barrelnut socket adapter that may be used to remove castlenuts and barrel nuts from firearms.

1 Claim, 14 Drawing Sheets

(56) References Cited

U.S. PATENT DOCUMENTS

| | | | | |
|---|---|---|---|---|
| D718,103 | S | 11/2014 | Geissele | |
| D725,451 | S | 3/2015 | Mayberry et al. | |
| D728,333 | S * | 5/2015 | Sui | D8/17 |
| D730,130 | S | 5/2015 | Geissele | |
| 9,080,837 | B2 | 7/2015 | Horne | |
| 9,372,041 | B1 | 6/2016 | Geissele | |
| 9,415,490 | B2 | 8/2016 | Cheng | |
| 9,448,027 | B1 * | 9/2016 | Zinsner | F41A 21/482 |
| D772,028 | S * | 11/2016 | Tangreen | D8/17 |
| 9,506,711 | B2 | 11/2016 | Gomez | |
| D779,298 | S * | 2/2017 | Tempel | D8/29 |
| D799,924 | S * | 10/2017 | Koiwa | D8/29 |
| 2014/0248136 | A1 * | 9/2014 | Lucas | F01D 5/026 415/151 |
| 2015/0290780 | A1 * | 10/2015 | Bennett | B25B 13/50 81/121.1 |
| 2015/0362108 | A1 * | 12/2015 | Lefebvre | F16L 15/08 285/89 |
| 2017/0254610 | A1 * | 9/2017 | Hill | F41A 21/482 |

OTHER PUBLICATIONS

Internet web page: https://www.amazon.com/BarrelWrenchSmithWessonP1522/dp/B00GX4HYJM, by amazon.com, "Barrel Nut Wrench (PRO) for the Smith & Wesson M&P15-22.".

Internet web page: https://www.axclactical.com/Barrel-Nut-Wrench-AR-15-p/ar15barrelnutwrench.htm, by axctactical.com, "Guntec USA AR15 Torque Wrench Barrel Nut Adapter.".

Internet web page: https://www.noveske.com/products/nsr-1-1-16-torque-wrench-adapter, by noveske.com, "NSR Barrel Nut Wrench.".

Internet web page: https://www.amazon.com/FreeFloatConverterWrenchCombo/dp/B00GRDH9JY, by amazon.com, "SIG 522 LR Free Float HG Converter and Wrench Combo.".

* cited by examiner

COMBINATION CASTLENUT AND BARRELNUT SOCKET ADAPTER FOR USE WITH TORQUE CREATING DEVICES

DETAILED DESCRIPTION OF THE EMBODIMENTS

An article of manufacture is disclosed which will be called a combination castlenut and barrelnut socket adapter; it is also referred to sometimes as a CN & BN socket adapter.

As used in this application, the term "M4 style weapon" includes the M16, AR15, M4 and similar firearms, as well as firearms whose designs are approximately similar to, or which are directly or indirectly derived from, previously and currently produced versions of the M16, AR15 and M4.

M4 style weapons use a barrel nut (shown as 21 in FIG. 2) to firmly affix the barrel to the upper receiver. In order to remove the barrel from the upper receiver, it is first necessary to remove the barrel nut.

Figure 1:
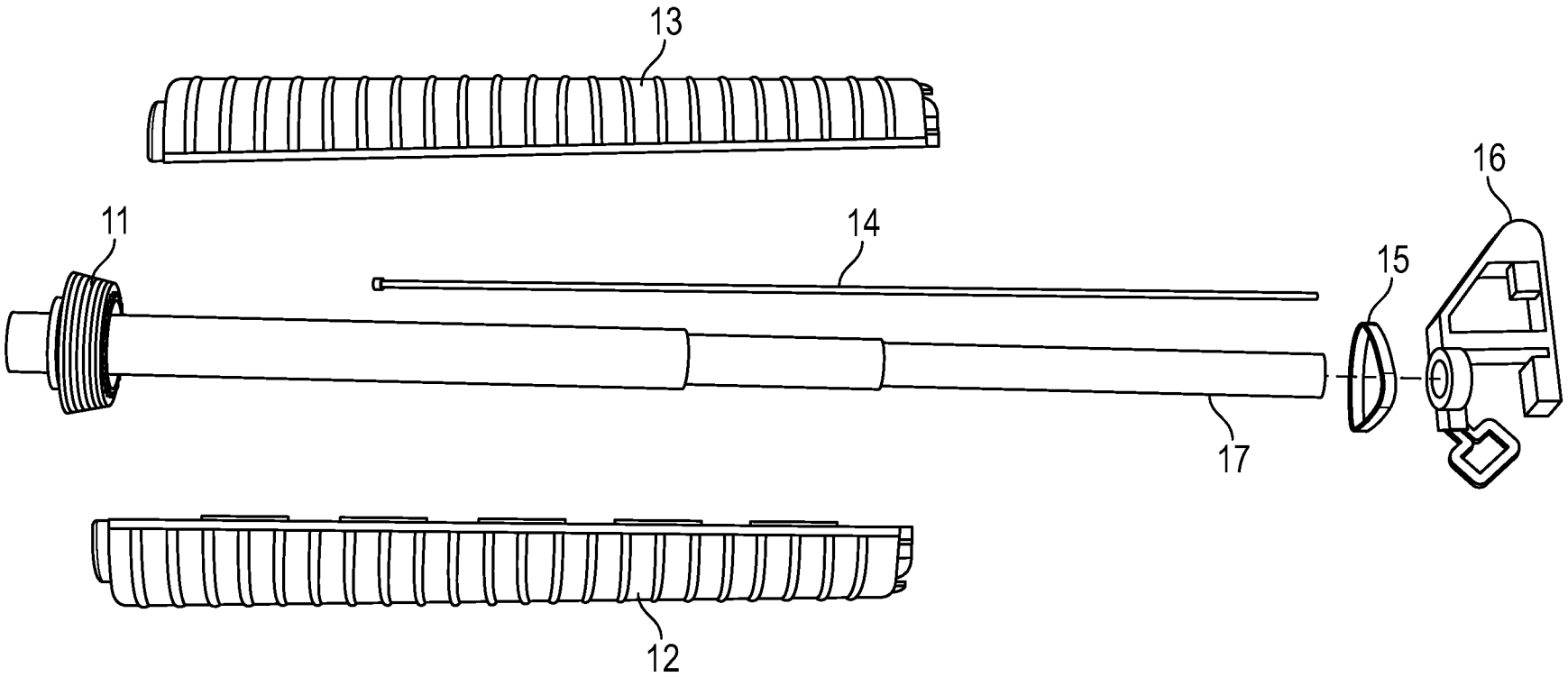
FIG. 1 is a semi-exploded view of the barrel and surrounding parts of an M4 style weapon viewed from the right side of the barrel of the weapon.

Certain parts of an M4 style weapon are typically disassembled in order to gain access to the barrel nut. FIG. 1 illustrates the parts that are typically disassembled in order to gain access to the barrel nut. As shown by FIG. 1, there is a delta ring, 11, near the base of the barrel, 17. When this delta ring is pushed back against its internal spring loaded tensioner and in the direction of the upper receiver, it is then possible to remove the bottom handguard, 12, the top handguard, 13, the gas tube, 14, the handguard end cap, 15 and the gas block, 16 in order to leave only an exposed barrel, 17.

Figure 2:
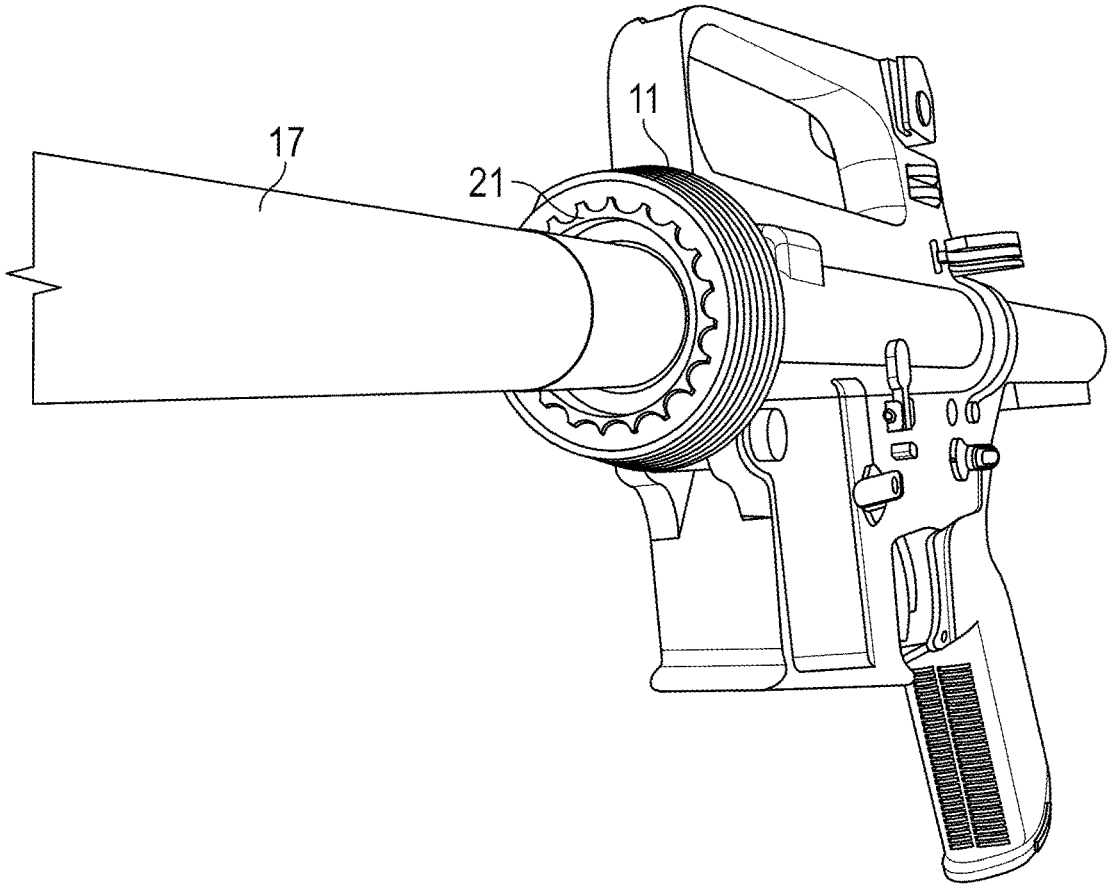
FIG. 2 is a view of a barrelnut inside of a delta ring on an M4 style weapon viewed from the left front of the weapon, looking along the weapon's barrel.

FIG. 2 shows that, once certain parts of the M4 style weapon are disassembled in the manner shown in FIG. 1, the barrel nut, 21, which fits inside the delta ring, 11, may be accessed; the barrel, 17, protrudes through the barrel nut which secures the barrel to the upper receiver of the M4 style weapon.

Figure 3:
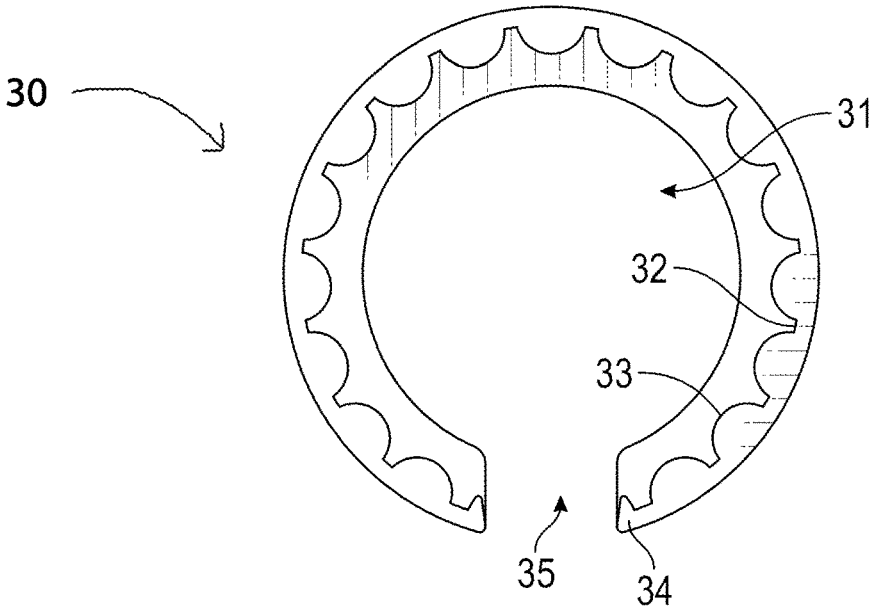
FIG. 3 is an isometric illustration from an end perspective of an embodiment, in one form, of the barrelnut adapter socket of a combination castlenut and barrelnut socket adapter.

FIG. 3 shows an embodiment, in one form, of a barrelnut engagement portion, 30, of the CN & BN socket adapter. The barrelnut engagement portion is designed to securely engage the barrel nut, 21, so that torque can be applied to the barrel nut in order to remove it. The form of the embodiment disclosed in FIG. 3 shows a barrelnut adapter socket, 31, a plurality of bottom lands, 32, and a plurality of cylindania-shaped teeth, 33, two partial cylindania-shaped teeth, 34 and a positional stock rail clearing notch, 35. All of these are configured to conformably and securely grip the corresponding counter surfaces on the exterior of the barrel nut.

Although the embodiment disclosed in FIG. 3 shows two partial cylindania-shaped teeth, 34, it is possible to satisfactorily construct the barrelnut engagement portion of the CN & BN socket adapter to function as intended without them and the inclusion of either or both partial cylindania-shaped teeth is optional.

Figure 4:
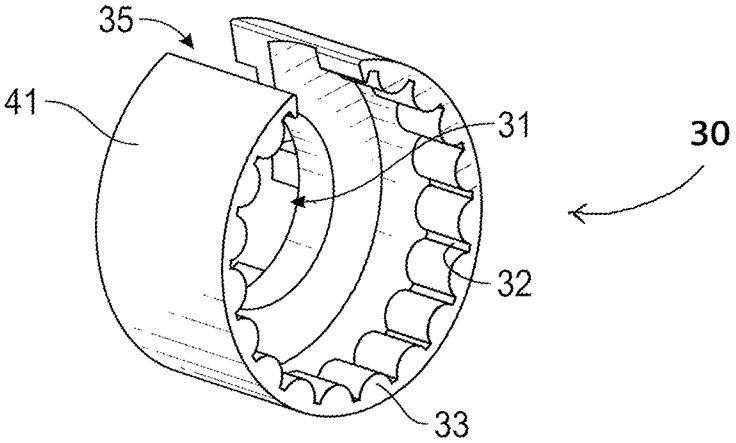
FIG. 4 is an illustration from an angled perspective of an embodiment, in one form, of the barrelnut adapter socket of a combination castlenut and barrelnut socket adapter.

FIG. 4 shows the same embodiment, in one form, of a barrelnut engagement portion, 30, of the CN & BN socket adapter depicted in FIG. 3, but from a different perspective.

As shown by FIG. 4, in one embodiment, the CN & BN socket adapter, possesses a cylindrical gripping face, 41. Although a cylindrical gripping face is illustrated in FIG. 4, the disclosure made in this application is intended to cover a gripping face of any configuration that can serve as an interface with any tool that can be used to generate torque on the barrel nut when gripped by a tool that can be used to generate torque on the exterior face of the CN & BN socket adapter.

Figure 5:
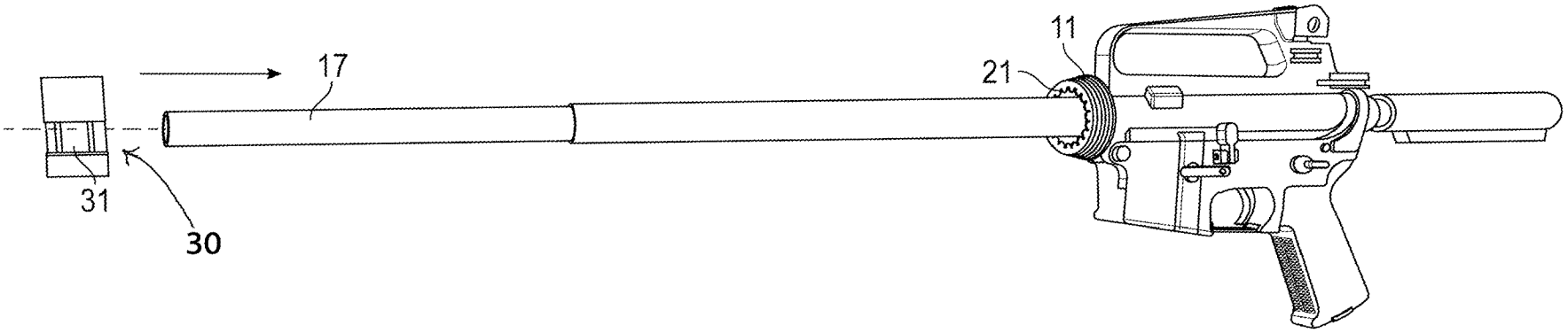
FIG. 5 is an illustration of an embodiment, in one form, of the barrelnut adapter socket being fitted over a barrel of an M4 style weapon so as to be able to mate with a barrelnut.

FIG. 5 shows, in one embodiment, how the barrelnut engagement portion of the CN & BN socket adapter can slide down the barrel, 17, to securely engage and conformably fit over the barrel nut, 21.

Figure 6:
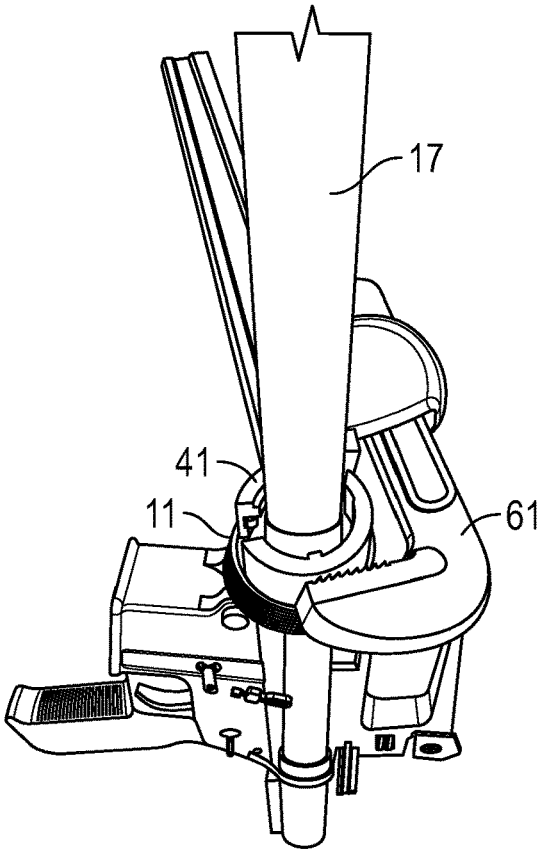
FIG. 6 is an illustration of an embodiment, in one form, of the barrelnut adapter socket being fitted over a barrelnut and of one form of a torque creating device being fitted over an embodiment, in one form, of a combination castlenut and barrelnut socket adapter to apply torque to unscrew the barrelnut.

FIG. 6 shows how one embodiment of the CN & BN socket adapter can be fitted over the barrel nut and also how an embodiment of a torque creating device, 61, can be used to engage with the cylindrical gripping face, 41, in order for a user of the torque creating device to be able to unscrew the barrel nut. Note that although a pipe wrench is the embodiment of the torque creating device depicted in FIG. 6, the torque creating device can be any other tool which is capable of engaging the cylindrical gripping face and providing a user leverage with which to generate torque to unscrew the barrel nut.

Figure 7:
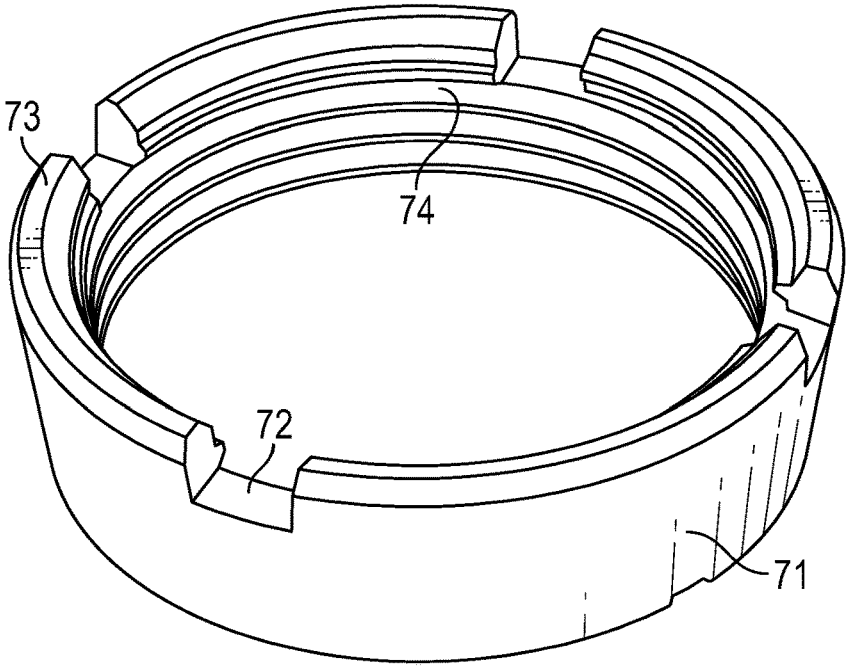
FIG. 7 is an isometric illustration of a castlenut that is used on an M4 style weapon.

FIG. 7 shows an embodiment, in one form, of a castlenut, 71. The castlenut is comprised of a plurality of crenels, 72, a plurality of parapets, 73 and contains threading, 74, on its interior.

Figure 8:
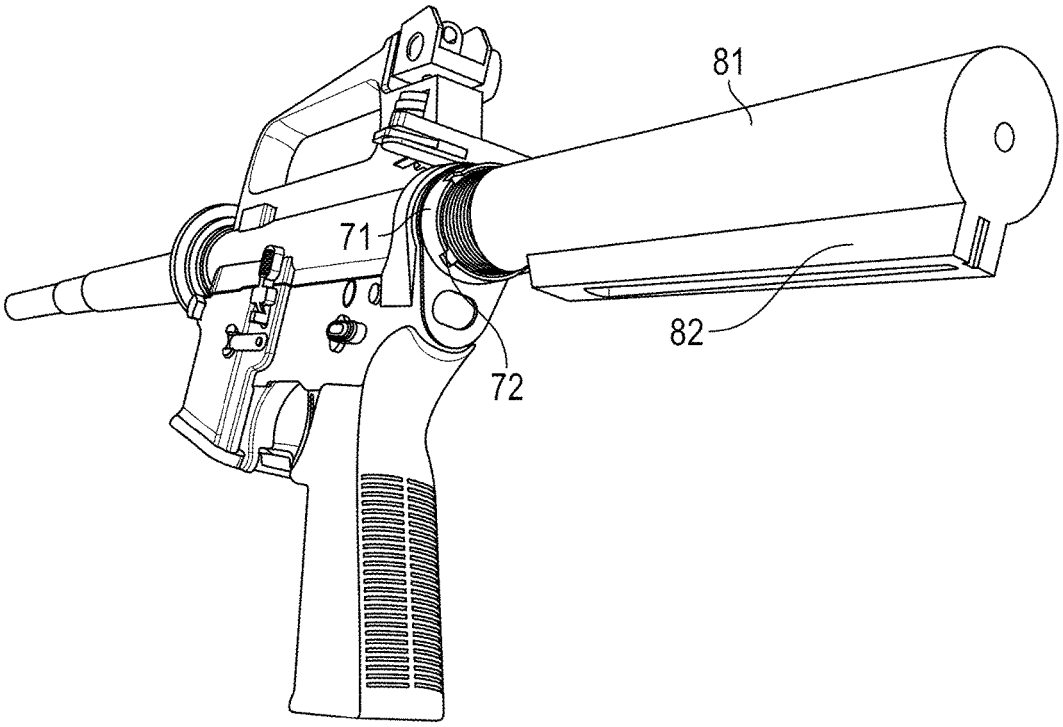
FIG. 8 is a view of a castlenut on an M4 style weapon viewed from the butt of the weapon after the weapon's stock has been removed in order to gain access to the castlenut.

FIG. 8 shows the placement of a castlenut, 71, as well as the crenel, 72, on an embodiment of an M4 style weapon. FIG. 8 further shows a buffer tube, 81, and a positional stock rail, 82, on an M4 style weapon.

Figure 9:
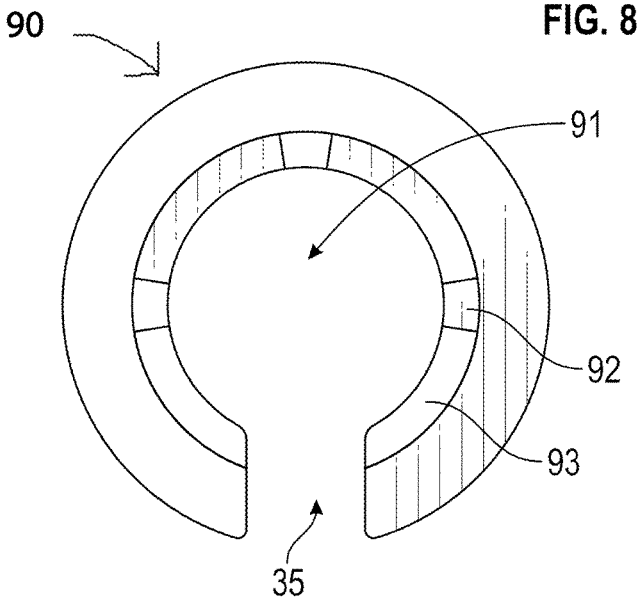
FIG. 9 is an isometric illustration from an end perspective of an embodiment, in one form, of the castlenut adapter socket of the combination castlenut and barrelnut socket adapter.

FIG. 9 shows an embodiment, in one form, of the castlenut engagement portion, 90, of a CN & BN socket adapter in which a castlenut adapter socket, 91, is shown adjacent to a positional stock rail clearing notch, 35, a plurality of reverse crenellated teeth, 92, and reverse parapet bottom lands, 93.

Figure 10:
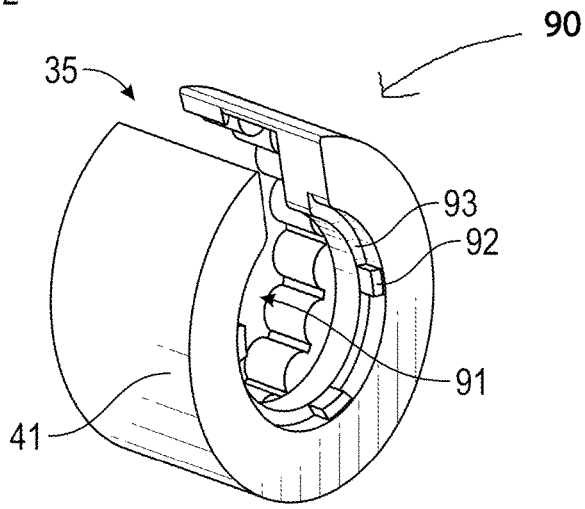
FIG. 10 is an illustration from an angled perspective of an embodiment, in one form, of the castlenut adapter socket of a combination castlenut and barrelnut socket adapter.

FIG. 10 shows the same embodiment, in one form, of the CN & BN socket adapter depicted in FIG. 9 and additionally illustrates the existence of a cylindrical gripping face, 41, on the exterior of the disclosed embodiment.

Figure 11:
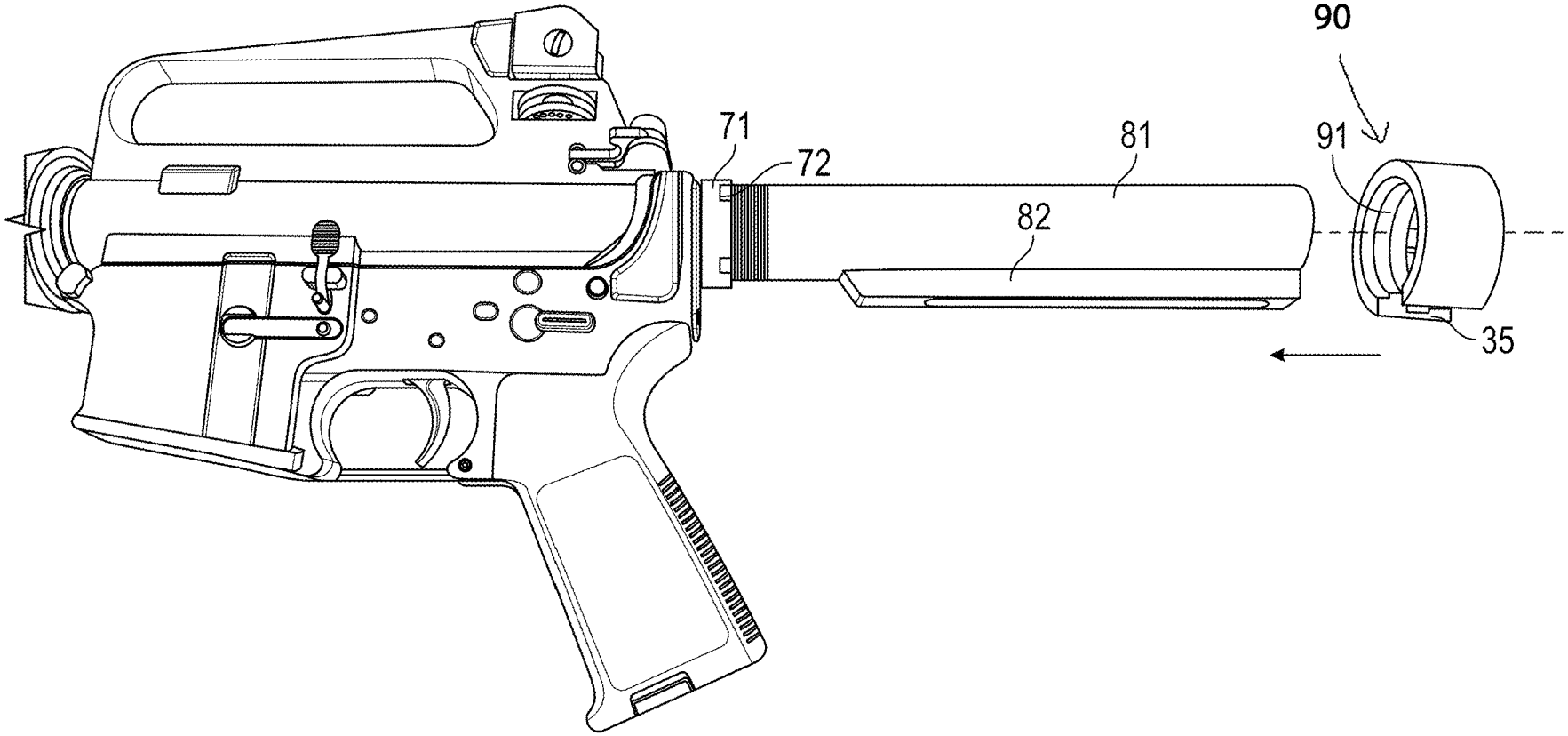
FIG. 11 is an illustration of an embodiment, in one form, of the castlenut adapter socket being fitted over a positional stock rail so as to be able to mate with a castlenut.

FIG. 11 shows the same embodiment, in one form, of the CN & BN socket adapter depicted in FIGS. 9 and 10 being positioned in such a manner that it can slide over the buffer tube, 81, with the positional stock rail clearing notch, 35, positioned in such a manner that the positional stock rail, 82, will pass through the positional stock rail clearing notch, thereby allowing castlenut engagement portion, 90, and its castlenut adapter socket, 91, to engage the castlenut, 71.

Figure 12:
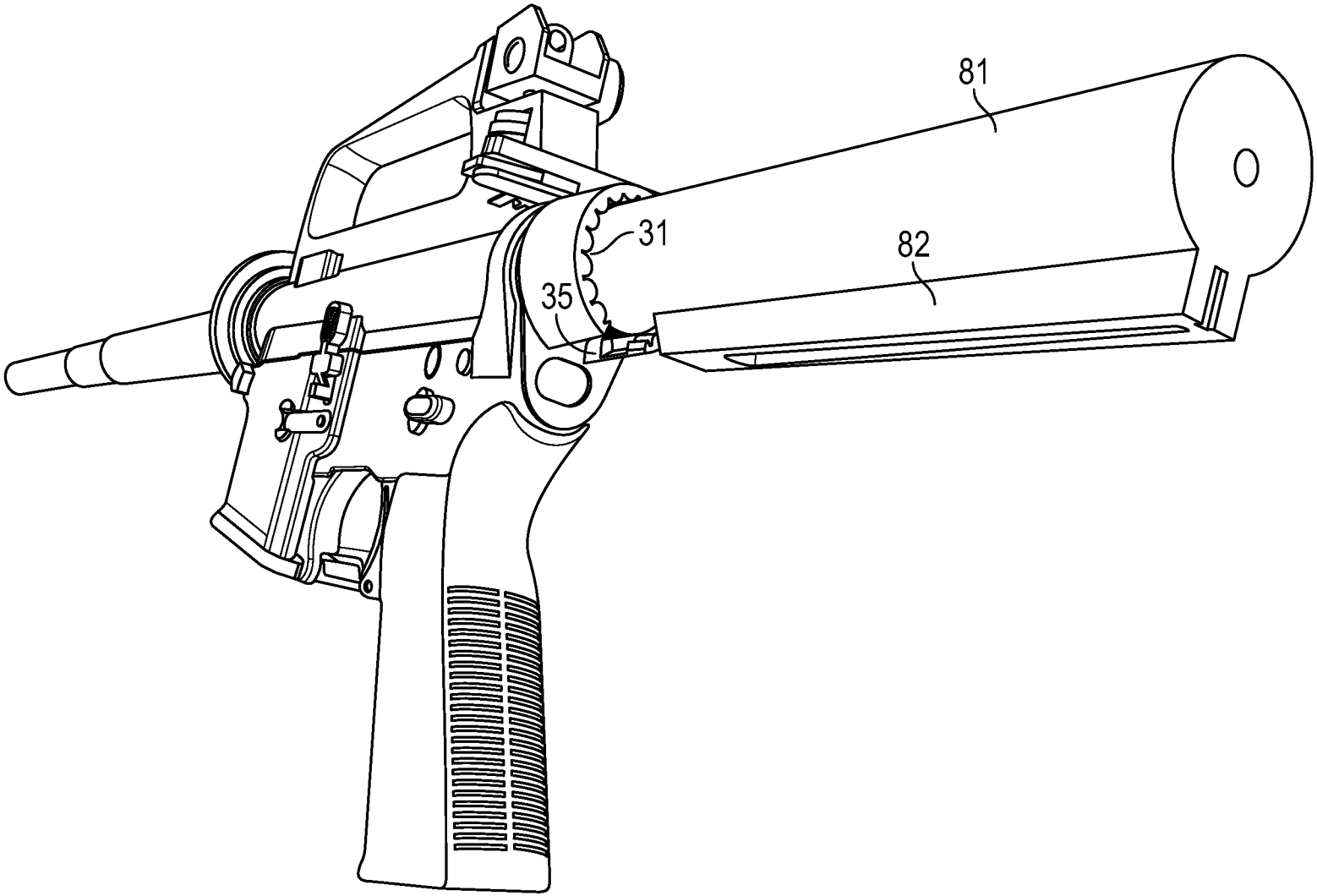
FIG. 12 is an illustration of an embodiment, in one form, of the castlenut adapter socket being fitted over a positional stock rail so as to be able to mate with a castlenut.

FIG. 12 shows the same embodiment, in one form, of the CN & BN socket adapter depicted in FIGS. 9, 10 and 11, fitted over the buffer tube, 81, so as to be able to mate with a castlenut.

Figure 13:
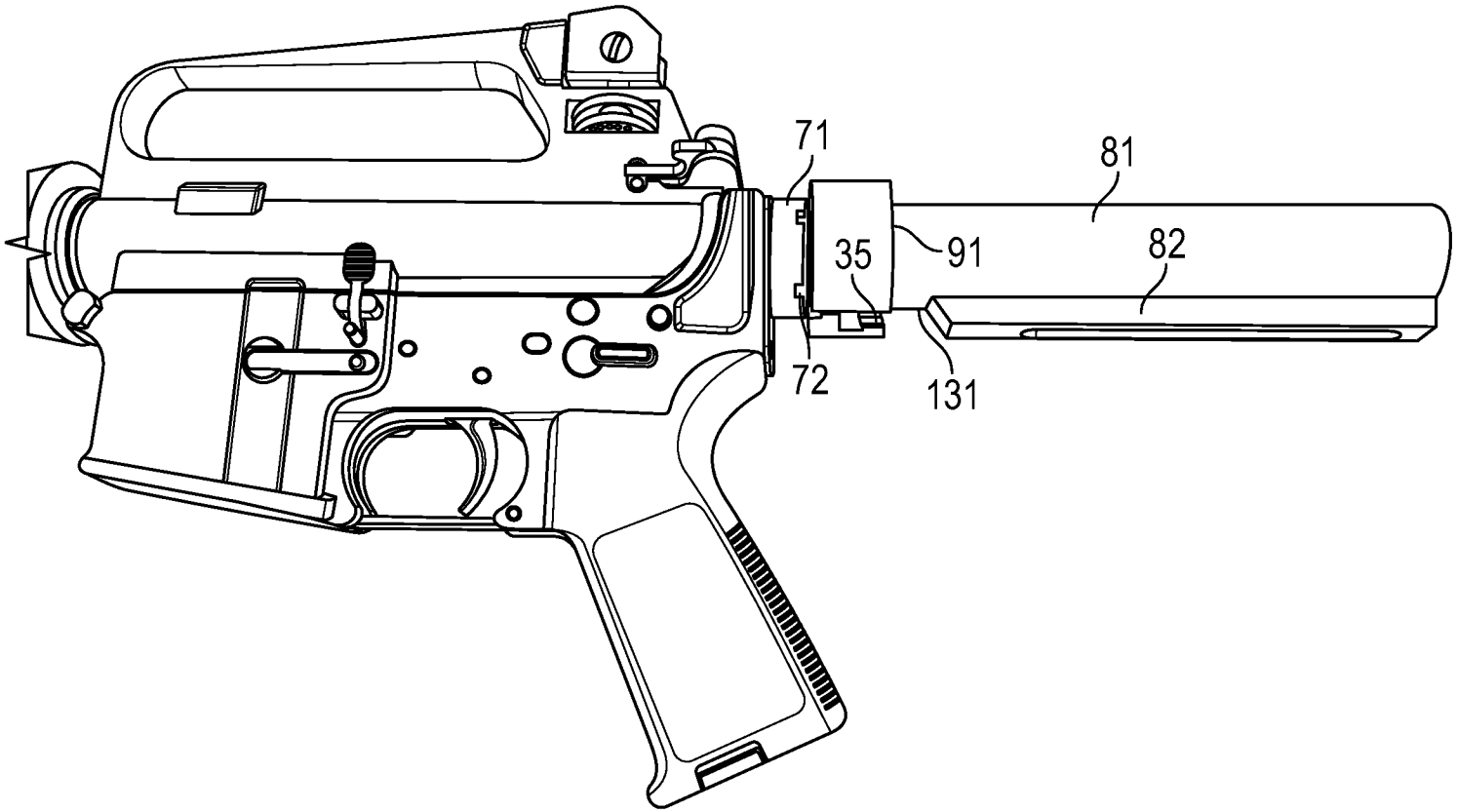
FIG. 13 is an illustration from a side perspective of an embodiment, in one form, of the castlenut adapter socket being fitted over a positional stock rail so as to be able to mate with a castlenut and further illustrating an ability of the combination castlenut and barrelnut socket adapter to be able to clear the positional stock rail when the castlenut adapter socket is turned.

FIG. 13 shows the same embodiment, in one form, of the CN & BN socket adapter depicted in FIGS. 9, 10, 11 and 12, and also shows that there is a clearance space, 131, between the end of the CN & BN socket adapter and the positional stock rail, 82, thus allowing the CN & BN socket adapter to be able to clear the positional stock rail when the CN & BN socket adapter is turned.

Figure 14:
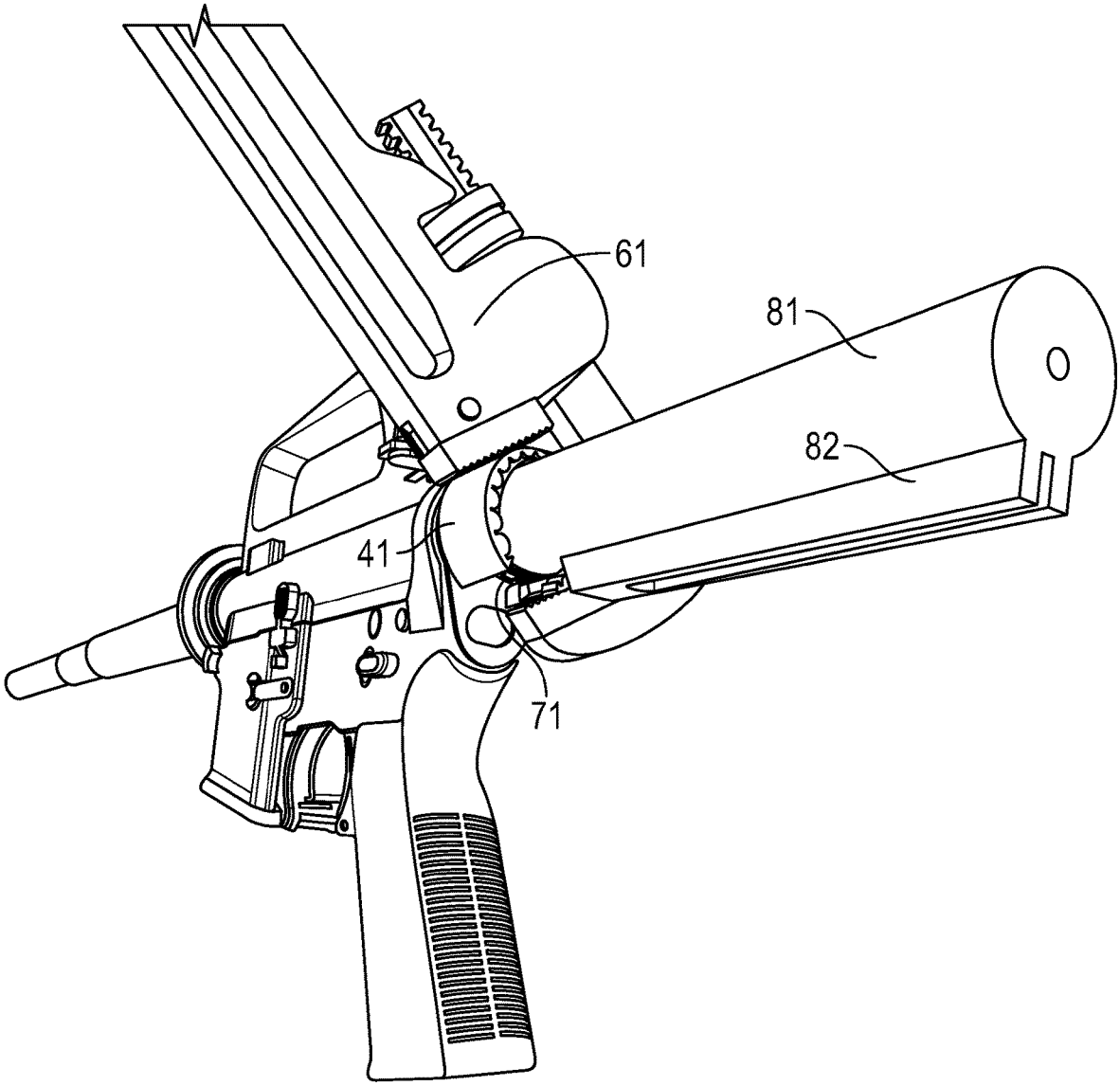
FIG. 14 is an illustration of an embodiment, in one form, of the castlenut adapter socket being fitted over a castlenut and of one form of a torque creating device being fitted over an embodiment, in one form, of a combination castlenut and barrelnut socket adapter.

FIG. 14 shows the same embodiment, in one form, of the CN & BN socket adapter depicted in FIGS. 9, 10, 11, 12 and 13, being gripped by a torque creating device, 61. Although a pipe wrench is illustrated as being the torque creating device in FIG. 14, any suitable tool may be used that can be used to create sufficient torque to turn the CN & BN socket adapter when it is mated with the castlenut.

When the castlenut adapter socket is fitted over the castlenut, the reverse crenellated teeth fit conformably into the crenels. This, combined with the threading inside the castlenut, causes the castlenut to rotate when a sufficient amount of torque is applied to the CN & BN socket adapter using a suitable torque creating device.

Although the embodiment of the CN & BN socket adapter disclosed by FIGS. 3, 4, 5, 6, 9, 10, 11, 12, 13 and 14 possesses a cylindrical gripping face, other embodiments of the CN & BN socket adapter can be produced that do not possess a cylindrical gripping face. For instance, it is possible to create embodiments in which the outer face of the CN & BN socket adapter is approximately polygonal in shape, as discussed below and as illustrated in FIGS. 15, 16, 17, 18, 19, 20 and 21 or which is only approximately cylindrical.

Figure 15:
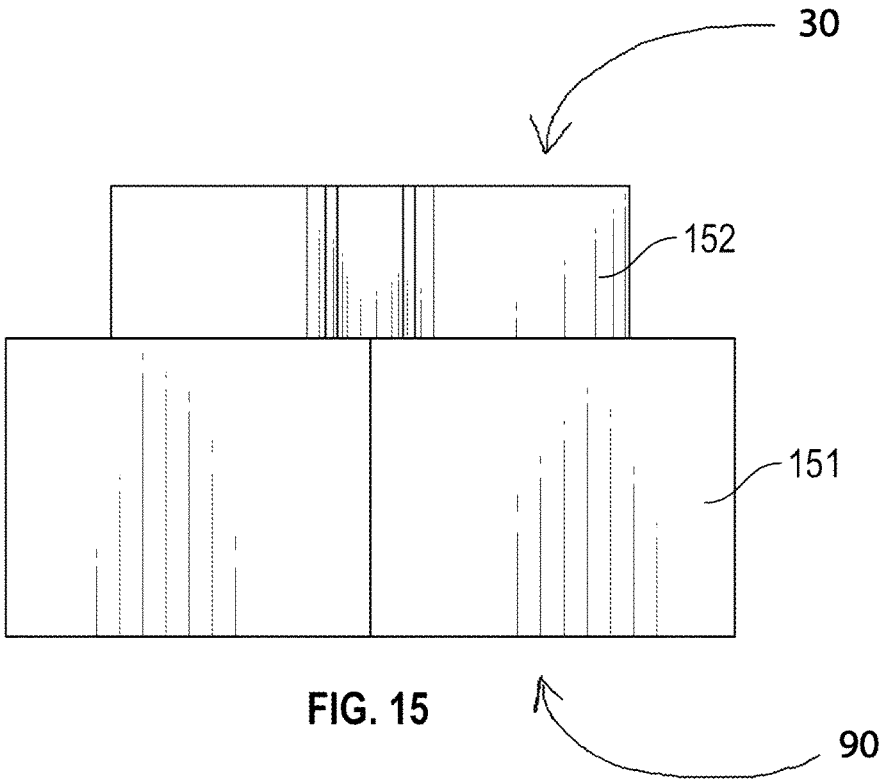
FIG. 15 is an isometric illustration of a side view of an alternative embodiment, in one form, of the combination castlenut and barrelnut socket adapter where the notch portion that is conformably made to be able to clear the positional stock rail on the butt of the weapon is positioned in the forefront of the perspective.

FIG. 15 shows a side view of an embodiment, in one form, of the CN & BN socket adapter in which the positional stock rail clearing notch that is conformably made to be able to clear the positional stock rail on the butt of the weapon is positioned in the forefront of the perspective. The depicted embodiment possesses a polygonal gripping face, 151, and a protruding barrelnut engagement portion, 152. The barrelnut engagement portion, 30, is depicted at the top of FIG. 15 and the castlenut engagement portion, 90, is depicted at the bottom of that same Figure.

Figure 16:
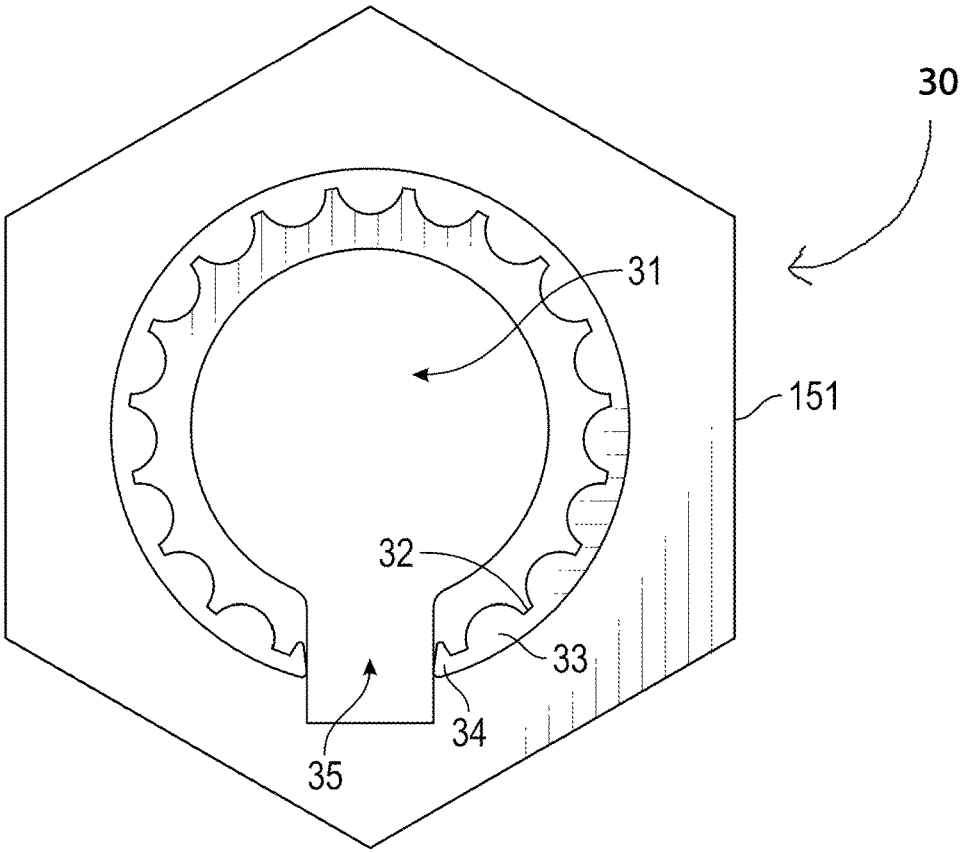
FIG. 16 is an isometric illustration from an end perspective of an alternative embodiment, in one form, of the barrelnut adapter socket of the combination castlenut and barrelnut socket adapter.

FIG. 16 is a perspective of an embodiment, in one form, of the CN & BN socket adapter depicted in FIG. 15, but viewed from the perspective in which the barrelnut adapter socket, 31, of the barrelnut engagement portion, 30, is in the foreground. The plurality of bottom lands, 32, plurality of cylindania-shaped teeth, 33, plurality of partial cylandania teeth and the positional stock rail clearing notch, 35, are all visible from this perspective and the shape of the polygonal gripping face, 151, is also illustrated.

Figure 17:
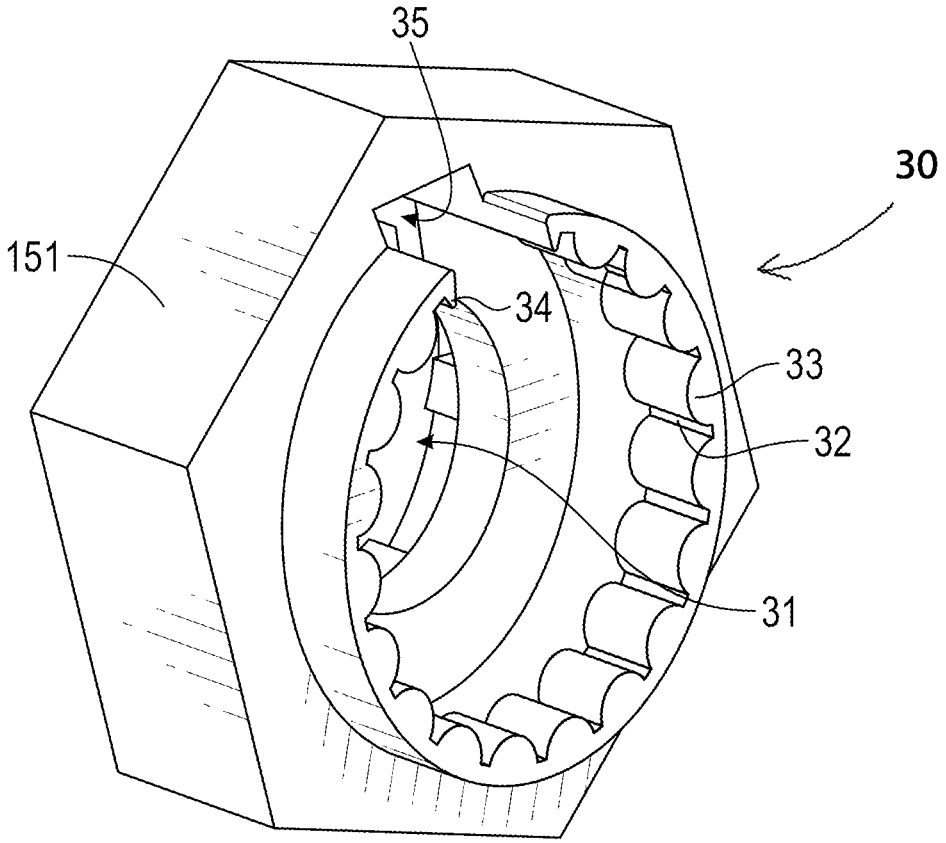
FIG. 17 is an illustration from an angled perspective of an alternative embodiment, in one form, of the barrelnut adapter socket of a combination castlenut and barrelnut socket adapter.

FIG. 17 is another perspective of the same embodiment, in one form, of the CN & BN socket adapter depicted in FIGS. 15 and 16, but shown from an angled perspective in order to better illustrate the three dimensional characteristics of the CN & BN socket adapter. In this perspective, the barrelnut adapter socket, 31, of the barrelnut engagement portion, 30, is shown in the foreground.

Figure 18:
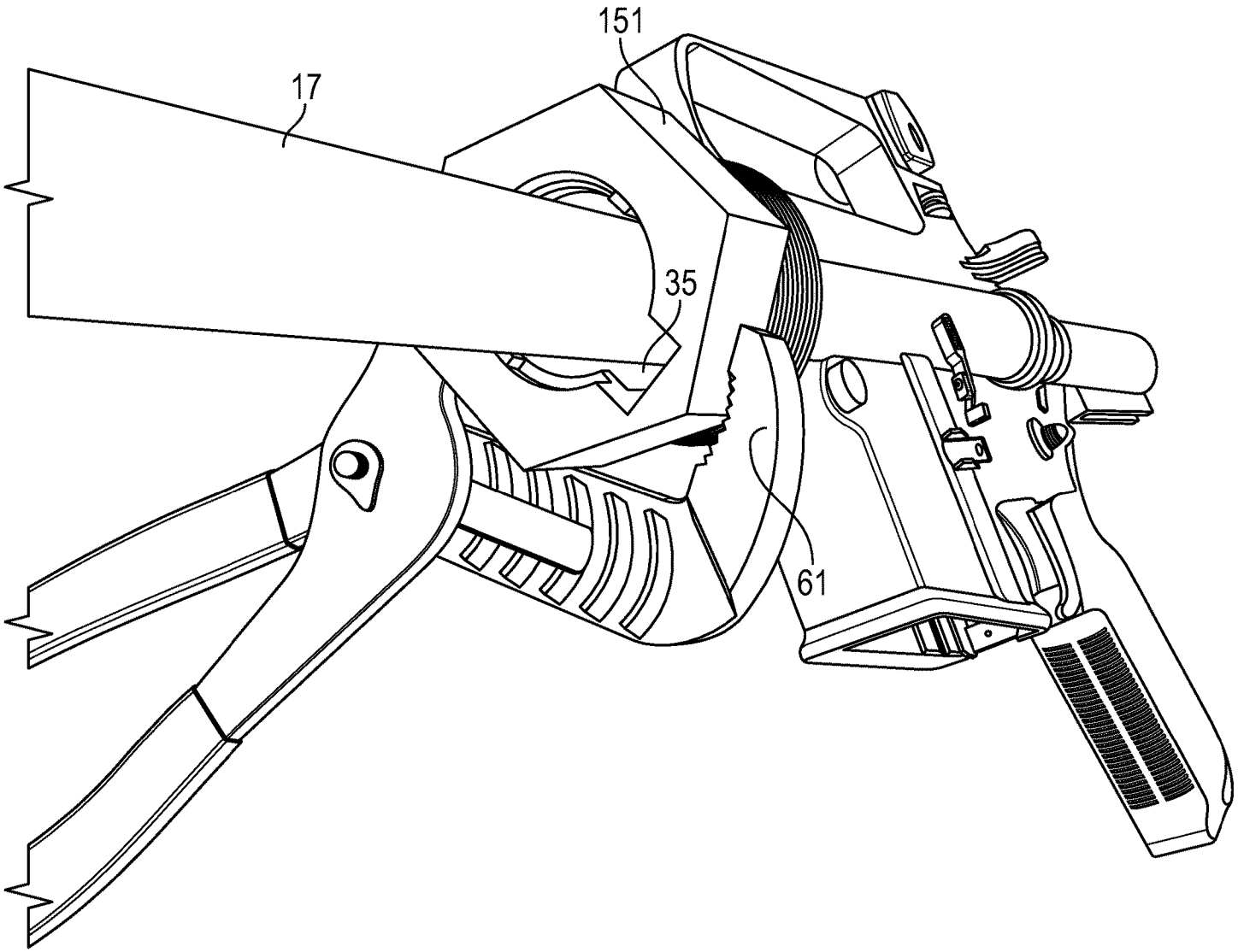
FIG. 18 is an illustration of an alternative embodiment, in one form, of the barrelnut adapter socket being fitted over a barrelnut and of one form of a torque creating device being fitted over an alternative embodiment, in one form, of a combination castlenut and barrelnut socket adapter.

FIG. 18 shows how one embodiment of the CN & BN socket adapter, in the same embodiment depicted in FIGS. 15, 16 and 17, can be fitted over the barrel nut and also how an embodiment of a torque creating device, 61, can be used to engage with the polygonal gripping face, 151, in order for a user of the torque creating device to be able to unscrew the barrel nut. Note that although a pair of adjustable pliers is shown as being used as the embodiment of the torque creating device depicted in FIG. 18, the torque creating device can be any other tool which is capable of engaging the polygonal gripping face and providing a user leverage with which to generate torque to unscrew the barrel nut.

Figure 19:
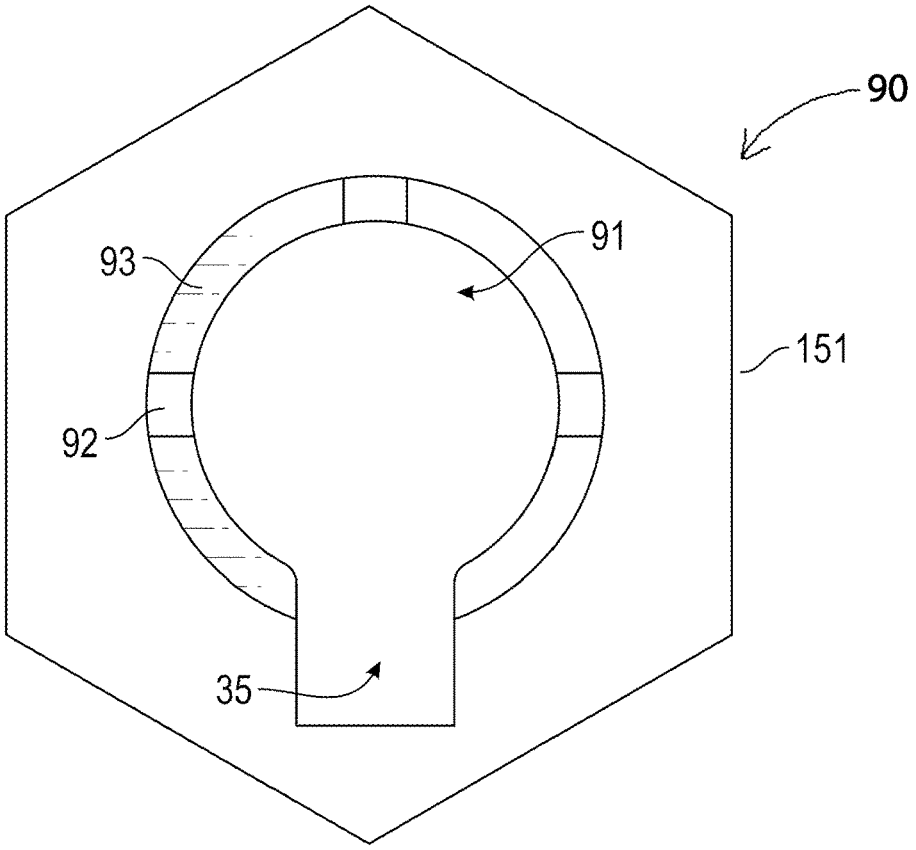
FIG. 19 is an isometric illustration from an end perspective of an alternative embodiment, in one form, of the castlenut adapter socket of the combination castlenut and barrelnut socket adapter.

FIG. 19 depicts the castlenut engagement portion, 90, and also shows an embodiment of the CN & BN socket adapter, in the same embodiment depicted in FIGS. 15, 16, 17 and 18. FIG. 19 further depicts a castlenut adapter socket, 91, as adjacent to a positional stock rail clearing notch, 35, and further depicts a plurality of reverse crenellated teeth, 92, and a plurality of reverse parapet bottom lands, 93.

Figure 20:
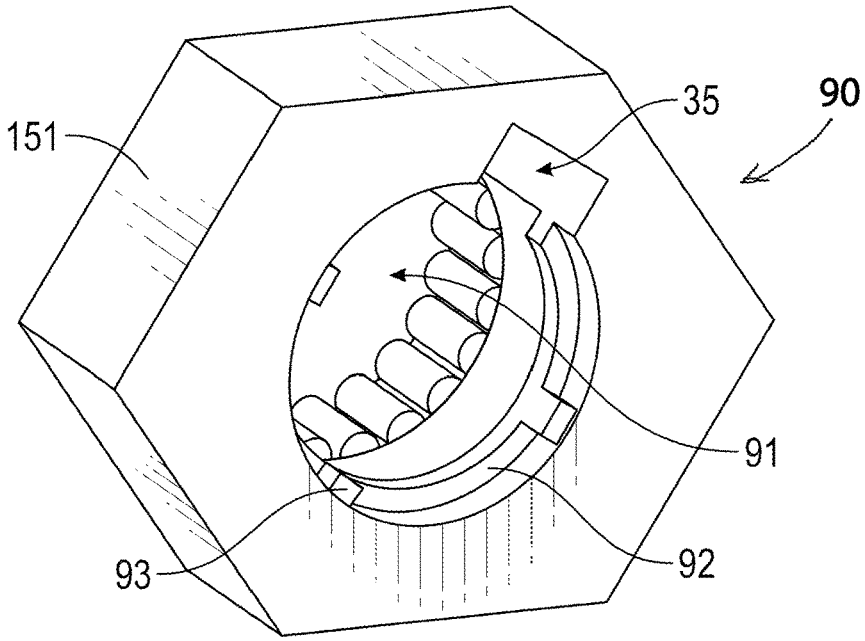
FIG. 20 is an illustration from an angled perspective of an alternative embodiment, in one form, of the castlenut adapter socket of the castlenut adapter socket of a combination castlenut and barrelnut socket adapter.

FIG. 20 depicts the castlenut engagement portion, 90, and also shows an embodiment of the CN & BN socket adapter, in the same embodiment depicted in FIGS. 15, 16, 17, 18 and 19 and additionally illustrates the existence of a polygonal gripping face, 151, on the exterior of the disclosed embodiment.

Figure 21:
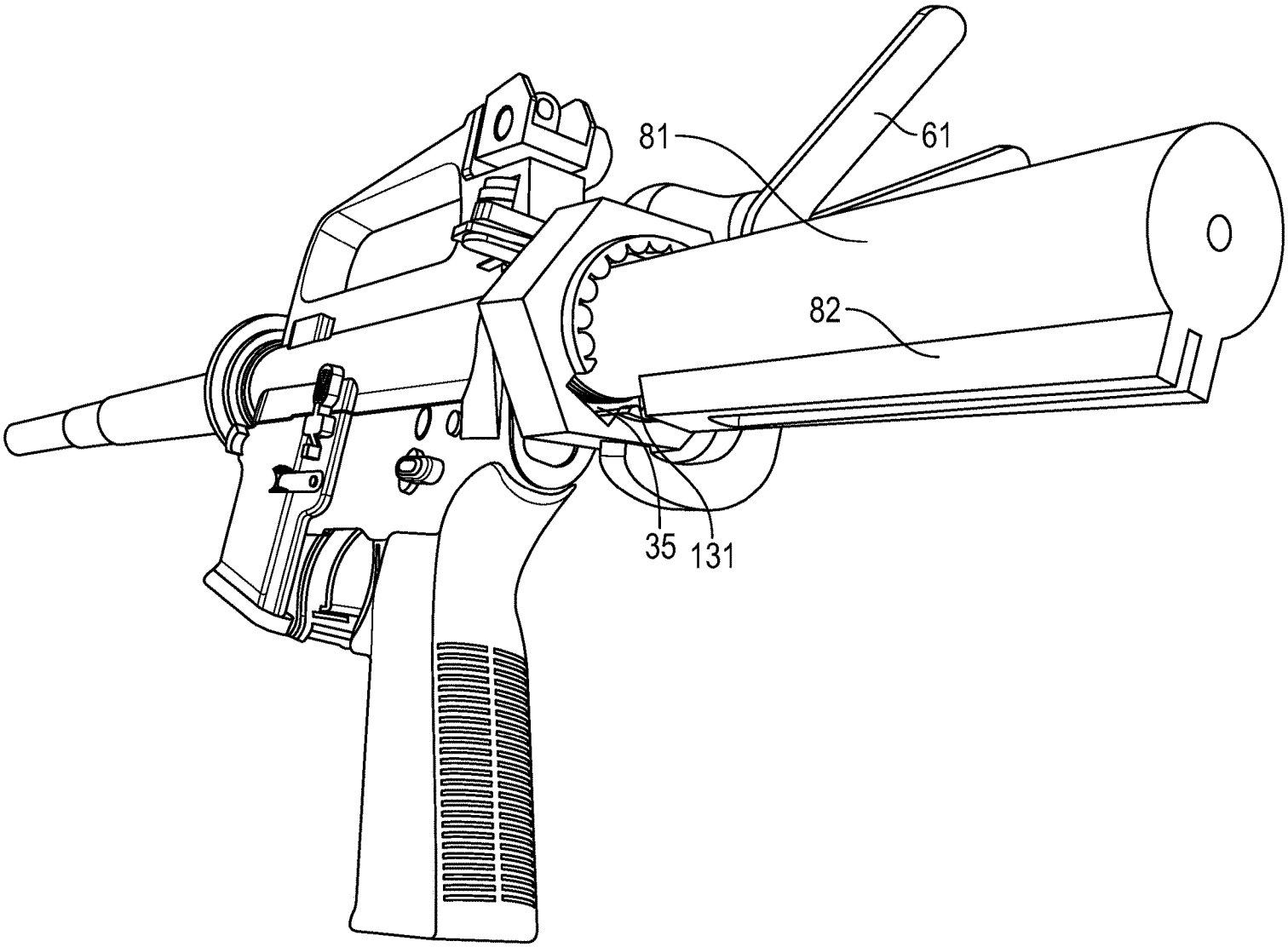
FIG. 21 is an illustration of an alternative embodiment, in one form, of the castlenut adapter socket being fitted over a castlenut and of one form of a torque creating device being fitted over an alternative embodiment, in one form, of a combination castlenut and barrelnut socket adapter.

FIG. 21 shows the same embodiment, in one form, of the CN & BN socket adapter depicted in FIGS. 15, 16, 17, 18, 19 and 20, being gripped by a torque creating device, 61. Although a pair of adjustable pliers is illustrated as being the torque creating device in FIG. 14, any suitable tool may be used that can be used to create sufficient torque to turn the CN & BN socket adapter when it is mated with the castlenut.

Therefore I claim:

1. A combined castlenut and barrelnut socket adapter to assist in the removal of a barrelnut or a castlenut from an M4 style weapon comprising barrelnut and castlenut engagement portions, said barrel nut engagement portion comprises a barrelnut adapter socket configured to fit over a barrel nut, at least one bottom land configured to securely grip a corresponding exterior surface of the barrel nut, at least one cylindania-shaped tooth configured to securely grip a corresponding exterior surface of the barrel nut, and a positional stock rail clearing notch configured to allow the barrel nut engagement portion to clear a positional stock rail on the butt of the M4 style weapon;

said castlenut engagement portion comprising a castlenut adapter socket configured to fit over a castlenut, at least one reverse crenellated tooth configured to securely grip a corresponding exterior surface of the castlenut, at least one reverse parapet bottom land configured to securely grip a corresponding exterior surface of the castlenut, a positional stock rail clearing notch configured to allow the castlenut engagement portion to clear a positional stock rail on the butt of the M4 style weapon;

wherein said socket adapter is provided without a handle and with an outside gripping surface configured for gripping engagement with a torque applying device.

* * * * *